US005510041A

United States Patent [19]

Sonnino

[11] Patent Number: 5,510,041

[45] Date of Patent: Apr. 23, 1996

[54] PROCESS FOR PRODUCING AN ORGANIC MATERIAL WITH HIGH FLAME-EXTINGUISHING POWER, AND PRODUCT OBTAINED THEREBY

[76] Inventor: Maddalena Sonnino, Via Valverde 20, 24100 Bergamo, Italy

[21] Appl. No.: 88,020

[22] Filed: Jul. 9, 1993

[30] Foreign Application Priority Data

Jul. 16, 1992 [IT] Italy ..... MI92A1733
Jan. 12, 1993 [IT] Italy ..... MI93A0024

[51] Int. Cl.[6] ..... A62D 1/04

[52] U.S. Cl. ..... 252/3; 252/2; 252/8.05; 252/7; 252/4

[58] Field of Search ..... 252/2, 3, 8.05

[56] References Cited

U.S. PATENT DOCUMENTS 4,665,993 5/1987 Balassa ..... 169/44
5,166,235 11/1992 Bertelli et al. ..... 524/93
5,300,606 4/1994 Aizawa et al. ..... 526/307.6

FOREIGN PATENT DOCUMENTS 876765 10/1979 Belgium .
2451201 10/1980 France .
396779 8/1933 United Kingdom .

*Primary Examiner*—Gary Geist
*Assistant Examiner*—Joseph D. Anthony
*Attorney, Agent, or Firm*—Guido Modiano; Albert Josif

[57] ABSTRACT

The process for producing an organic material for extinguishing fires involves mixing at least two kinds of cucurbits which have been divided into pieces, and collecting the water released by them.

The mixture is crushed and screened to obtain a very fine powder or a uniform pulp.

The powder or pulp is then mixed with at least one basic additive, chosen between sodium bicarbonate and calcium carbonate, in proportions comprised between 1.5% and 7% by weight; with a saline preservative, substantially salicylic acid, in a proportion comprised between 0.1% and 2% by weight; with water from the cucurbits, in a proportion comprised between 50 and 60%; and with at least one surfactant in a proportion comprised between 5% and 30% by weight.

25 Claims, No Drawings

PROCESS FOR PRODUCING AN ORGANIC MATERIAL WITH HIGH FLAME-EXTINGUISHING POWER, AND PRODUCT OBTAINED THEREBY

BACKGROUND OF THE INVENTION

The present invention relates to a process for producing an organic material, in the form of a powder and/or foam, having considerable flame-extinguishing properties and usable in current extinguishers and fire-fighting systems which use powder or foam products or the like.

As is known, the greatest difficulties encountered when extinguishing fires, whether small or large, arise from the fact that currently available extinguishing products are not always capable of creating an adequate inert atmosphere, capable of rapidly smothering the flames, around the region on fire.

Various kinds of extinguishing products are in fact used according to the characteristics of the fire to be put out: these products are, in addition to water, particular products which in some cases are constituted by foams, carbon dioxide snow, or halogenated liquids; products in powder form, for example mixtures of soda and inert substances, which generally perform a smothering and cooling action, are used in other cases.

It is also known that most of current fire-fighting products, although effective in terms of flame extinguishing, in practice have various drawbacks both in practical terms and, most of all, in ecological terms.

Many known extinguishing products in fact develop, when they come into contact with the flames, vapors and fumes which are almost always toxic, or are corrosive. Some of the known products do not maintain their qualitative properties when subjected to the pressures necessary to project the product onto the fire. Furthermore, many known products have a limited storage life since their characteristics change in a relatively short time.

SUMMARY OF THE INVENTION

Therefore, an aim of the present invention is to provide a process which, by using particular natural and organic products, is capable of producing a flame-extinguishing substance having such characteristics as to be usable in conventional extinguishers, both portable and fixed, as well as in fire-fighting systems, and to be highly versatile and most of all neither corrosive nor toxic.

Another object of the present invention is to provide an extinguishing product which withstands temperature and pressure changes, is ecologically harmless and is also such as to maintain its flow and extinguishing properties unchanged.

This aim, these objects and others which will become apparent from the following description are achieved by a process for producing an organic extinguishing product, said process consisting in:

providing and possibly drying a mixture constituted by at least two kinds of cucurbits which have been divided into pieces, collecting the water released by them;

subjecting said mixture to a crushing and screening process so as to obtain a very fine and uniform powder or a creamy and uniform pulp; then mixing said powder or pulp with at least one basic additive, chosen between sodium bicarbonate and calcium carbonate, in proportions comprised between 1.5% and 7% by weight based on the weight of the cucurbit powder or pulp; with a saline preservative, preferably salicylic acid, in a proportion comprised between 0.1% and 2% by weight based on the weight of the cucurbit powder or pulp; with water from said cucurbits in a proportion comprised between 50 and 70% by weight based on the weight of the cucurbit powder or pulp; and with at least one surfactant in a proportion comprised between 5% and 30% by weight based on the weight of the cucurbit powder or pulp.

More particularly, said water of the cucurbits receives the addition of stabilizers, chosen between $SnCl_4$ and $SnCl_2$, in such proportions as to produce, together with said mixed powder or pulp, a foam which can extinguish even fires produced by hydrocarbons. The stabilizers are preferably added in proportions between 1.5% and 20% by weight with respect to the water.

Furthermore, the mixture of said cucurbits is preferably constituted by 25–30% by weight of water-melon and by 70 to 75% by weight of cucumber based on the weight of the cucurbit powder or pulp; the percentage of each component being possibly present up to 50% by weight based on the weight of the cucurbit powder or pulp; said additive is constituted by sodium bicarbonate in proportions preferably comprised between 2% and 5% by weight based on the weight of the cucurbit powder or pulp; and said preservative is constituted by salicylic acid in proportions comprised between 0.1% and 1% by weight based on the weight of the cucurbit mixture.

Moreover, the present invention provides a chemical extinguishing product in the form of stabilized foam, comprising a mixture of at least two kinds of cucurbits in the form of a very fine and uniform dry powder with at least one basic additive, substantially sodium bicarbonate, at least one food preservative, substantially salicylic acid, said mixture being treated with water from said cucurbits and receiving the addition of at least one surfactant and of at least one inert stabilizer, substantially $SnCl_2$ and/or $SnCl_4$.

Furthermore, the present invention provides an extinguishing product in the form of a powder, comprising at least two kinds of cucurbits in the form of a very fine and uniform dry powder with at least one basic additive, substantially calcium carbonate, and at least one food preservative, substantially salicylic acid.

The process according to the present invention will become apparent from the following example of practical production.

DESCRIPTION OF THE PREFERRED EMBODIMENTS

EXAMPLE

Large quantities of water-melons and cucumbers are washed and possibly divided into pieces, separately collecting the water released by them; then they are separately subjected to a drying or freeze-drying process within an autoclave or the like at such a temperature and pressure as to completely dry the cucurbits; after cooling, the two separate dried components are crushed or ground until a uniform fine powder is obtained; the powder can be subsequently passed through a screen.

In order to obtain approximately 100 kg of extinguishing powder by using said fine powders, the following substances are cold-mixed under agitation in a container vessel with a capacity of approximately 150–160 liters:

25 kg of water-melon powder 75 kg of cucumber powder and the following substances are added and mixed to the mixture thus obtained:

2 kg of calcium carbonate or sodium bicarbonate 0.5 kg of salicylic acid.

The powder thus obtained is then mixed with water from the same cucurbits in a proportion of 60% by weight of water based on the weight of the mixture of cucurbit powders, with the addition of $SnCl_4$ (or $SnCl_2$) in a proportion of 18% by weight with respect to the water, and with at least one surfactant in a proportion of 25% by weight based on the weight of the mixture of cucurbit powders, so as to obtain a solution which, after stabilization with inert products, produces a foam having a high extinguishing and retardant power.

Also according to the present invention, the cucurbits can be used as they are, avoiding the drying process, since the water that they initially contain can be present throughout the entire process, so as to obtain a foaming product having the required characteristics, without the release of vapors emitted by said stabilizers from the solution which constitutes the foam.

Furthermore, the powder obtained according to the above described process can be used, in the absence of water additions from the cucurbits, of additives and surfactants, directly as a flame extinguishing powder; during practical tests conducted in a pool containing hexane measuring approximately 1 square meter, the fire was put out in a few seconds, mostly by smothering the flames, without emitting any fumes or vapors.

Said process thus allows, by using chemical powders having high extinguishing properties and derived from the use of cucurbits, to obtain a powder or foaming product which has no harmful ecological effects and is highly stable.

Obviously, in its practical production, the invention as described and exemplified above according to one of its possible embodiments is susceptible to equivalent modifications and variations, for example in the percentages of the individual components and in the types of cucurbits and stabilizing additives, without abandoning the protective scope of the present invention.

What is claimed is:

1. Chemical fire extinguishing product in the form of stabilized foam, comprising a mixture of at least two kinds of cucurbits in the form of a very fine and uniform dry powder with at least one basic additive selected from a group consisting in sodium bicarbonate and calcium carbonate, in proportions between 1.5% and 7% by weight based on the weight of the dry cucurbits, and at least one food preservative in proportions between 0.1% and 2% by weight based on the weight of the dry cucurbits said mixture being treated with water from said cucurbits in proportions between 50% and 70% by weight based on the weight of the dry cucurbits, at least one surfactant in proportions between 5% and 30% by weight based on the weight of the dry cucurbits and at least one inert stabilizer in proportions between 1.5% and 20% by weight with respect to the water.

2. Chemical fire extinguishing product according to claim 1, wherein said basic additive is sodium bicarbonate.

3. Chemical fire extinguishing product according to claim 1, wherein said food preservative is salicylic acid.

4. Chemical fire extinguishing product according to claim 1, wherein said stabilizer is selected from the group consisting of $SnCl_2$ and $SnCl_4$.

5. Fire extinguishing product in the form of a powder, comprising at least two kinds of cucurbits in the form of a very fine and uniform dry powder with at least one basic additive selected from a group consisting in sodium bicarbonate and calcium carbonate, in proportions between 1.5% and 7% by weight based on the weight of the dry cucurbits, and at least one food preservative in proportions between 0.1% and 2% by weight based on the weight of the dry cucurbits.

6. Fire extinguishing product according to claim 5, wherein said basic additive is calcium carbonate.

7. Fire extinguishing product according to claim 5, wherein said food preservative is salicylic acid.

8. Process for producing an organic product with high fire extinguishing and fire retardant power, comprising the steps of:

providing and drying a mixture constituted by at least two kinds of cucurbits which have been divided into pieces, collecting the water released by them;

subjecting said mixture to a crushing and screening process so as to obtain a very fine and uniform powder; and then mixing said powder with at least one basic additive, selected from the group consisting of sodium bicarbonate and calcium carbonate, in proportions comprised between 1.5% and 7% by weight based on the weight of the powder; with a saline preservative, in a proportion comprised between 0.1% and 2% by weight based on the weight of the powder; with water from said cucurbits, in a proportion comprised between 50 and 70% by weight based on the weight of the powder; and with at least one surfactant in a proportion comprised between 5% and 30% by weight based on the weight of the powder.

9. Process according to claim 8, wherein stabilizers selected from the group consisting of $SnCl_4$ and $SnCl_2$ are added to said water of the cucurbits, in a proportion comprised between 1.5% and 20% by weight with respect to the water.

10. Process according to claim 8, wherein said cucurbits are selected from the group consisting of water-melons, cucumbers, melons and pumpkins.

11. Process according to claim 8, wherein said cucurbit mixture is constituted by 25% to 70% by weight of water-melon and by 20% to 75% by weight of cucumber.

12. Process according to claim 8, wherein said cucurbit mixture is constituted by 50% by weight of one cucurbit and by 50% by weight of another cucurbit.

13. Process according to claim 1, wherein said basic additive is comprised between 2% and 5% by weight based on the weight of the powder.

14. Process according to claim 8, wherein said saline preservative is present in a proportion comprised between 0.1% and 1% by weight based on the weight of the powder.

15. Process according to claim 8, wherein said surfactant is present in a proportion comprised between 10% and 25% by weight with respect to the powder.

16. Process according to claim 8, wherein said preservative is salicylic acid.

17. Process for producing an organic product with high fire extinguishing and fire retardant power, comprising the steps of:

obtaining a cucurbit mixture by mixing at least two kinds of cucurbits which have been divided into pieces and collecting the water released by them;

subjecting said cucurbit mixture to a crushing and screening process so as to obtain a creamy and uniform pulp; and then mixing said pulp with at least one basic additive, selected from the group consisting of sodium bicarbonate and calcium carbonate, in proportions comprised between 1.5% and 7% by weight based on the weight of the pulp; with a saline preservative, in a proportion comprised between 0.1% and 2% by weight based on the weight of the pulp; with water from said cucurbits, in a proportion comprised between 50 and 70% by weight based on the weight of the pulp; and with at least one surfactant in a proportion comprised between 5% and 30% by weight based on the weight of the pulp.

18. Process according to claim 17, wherein said preservative is salicylic acid.

19. Process according to claim 17, wherein cucurbits stabilizers selected from the group consisting of $SnCl_4$ and $SnCl_2$ are added to said water of the cucurbits, in a proportion comprised between 1.5% and 20% by weight with respect to the water.

20. Process according to claim 17, wherein said cucurbits are selected from the group consisting of water-melons, cucumbers, melons and pumpkins.

21. Process according to claim 17, wherein said cucurbit mixture is constituted by 25% to 70% by weight of water-melon and by 20% to 75% by weight of cucumber.

22. Process according to claim 17, wherein said cucurbit mixture is constituted by 50% by weight of one cucurbit and by 50% by weight of another cucurbit.

23. Process according to claim 17, wherein said basic additive is comprised between 2% and 5% by weight based on the weight of the pulp.

24. Process according to claim 17, wherein said saline preservative is present in a proportion comprised between 0.1% and 1% by weight based on the weight of the pulp.

25. Process according to claim 17, wherein said surfactant is present in a proportion comprised between 10% and 25% by weight with respect to the pulp.

* * * * *